US010494242B2

(12) United States Patent
Lippert et al.

(10) Patent No.: US 10,494,242 B2
(45) Date of Patent: Dec. 3, 2019

(54) WINE KEY

(71) Applicant: Kristin A. Lippert, Sandy Springs, GA (US)

(72) Inventors: Kristin A. Lippert, Sandy Springs, GA (US); Kristofer Laméy, Smyrna, GA (US)

(73) Assignee: Kristen A. Lippert, Sandy Springs, GA (US)

( * ) Notice: Subject to any disclaimer, the term of this patent is extended or adjusted under 35 U.S.C. 154(b) by 77 days.

(21) Appl. No.: 15/857,839

(22) Filed: Dec. 29, 2017

(65) Prior Publication Data

US 2018/0186616 A1 Jul. 5, 2018

Related U.S. Application Data

(60) Provisional application No. 62/440,007, filed on Dec. 29, 2016.

(51) Int. Cl.

| | |
|---|---|
| ***B67B 7/04*** | (2006.01) |
| ***B67B 7/16*** | (2006.01) |
| ***B67B 7/44*** | (2006.01) |

(52) U.S. Cl.

CPC ..... *B67B 7/0423* (2013.01); *B67B 7/16* (2013.01); *B67B 7/44* (2013.01)

(58) Field of Classification Search

CPC ..... B67B 7/0423; B67B 7/16; B67B 7/44; B67B 2007/0458

(Continued)

(56) References Cited

U.S. PATENT DOCUMENTS 327,983 A * 10/1885 Arment ..... B67B 7/44 7/154

455,826 A 7/1891 Davis (Continued)

FOREIGN PATENT DOCUMENTS

EP 1083143 A1 3/2001
EP 1151960 B1 12/2003

(Continued)

OTHER PUBLICATIONS alibaba.com, 2016 Hot Selling Color Wood Handle Bottle Opener Corkscrew, 2 pages, Internet website: http://www.alibaba.com/product-detail/2016-Hot-Selling-Color-Wood-Handle_1949503329/showimage.html , copy retrieved on Jul. 27, 2016.

(Continued)

*Primary Examiner* — Hadi Shakeri
(74) *Attorney, Agent, or Firm* — Barry E. Kaplan, Esq.

(57) ABSTRACT

The subject matter of the present disclosure relates, in various embodiments, to a wine key comprising a head assembly and a handle assembly. The head assembly may comprise a unique configuration suited for affixing and using a twin neckstand assembly, a foil cutter disk, a spring, and a helical extractor. The twin neckstand assembly may comprise fulcrum notches for providing leverage against a bottle rim to enhance the effectiveness of extracting a cork stopper from the bottle. As well, the twin neckstand assembly may comprise cap reliefs and cap hooks for providing leverage against a bottle cap edge, so as to enhance the effectiveness of its removal. The handle assembly may comprise a multi-part structure, comprising a handle, an offset tube, a central rod, and an end cap. In some embodiments, the handle may be provided in cylindrical-shaped form that can be turned on a lathe by a Do-It-Yourself woodworker.

20 Claims, 6 Drawing Sheets

(58) Field of Classification Search
USPC ..... 81/3.09
See application file for complete search history.

(56) References Cited

U.S. PATENT DOCUMENTS

| | | | | |
|---|---|---|---|---|
| 522,672 | A | 7/1894 | Puddefoot | |
| 1,361,021 | A | 12/1920 | Copeman | |
| 2,039,850 | A | 5/1936 | Silaj | |
| 2,057,949 | A | 10/1936 | Hodson | |
| 2,823,395 | A * | 2/1958 | Brownson | B67B 7/0411 30/1.5 |
| 4,437,359 | A | 3/1984 | Dejoux et al. | |
| 4,584,911 | A | 4/1986 | Cellini | |
| 5,454,282 | A | 10/1995 | Del Mistro | |
| D374,801 | S | 10/1996 | Puig et al. | |
| D385,763 | S | 11/1997 | Trivellato | |
| 5,887,305 | A * | 3/1999 | Cellini | B67B 7/0423 30/1.5 |
| D455,623 | S | 4/2002 | Farfalli | |
| 6,367,353 | B2 | 4/2002 | Brucart Puig et al. | |
| 6,598,297 | B1 | 7/2003 | Matt | |
| 6,732,392 | B2 * | 5/2004 | Kay | B26B 11/00 7/158 |
| 6,732,611 | B2 | 5/2004 | Miguel | |
| D496,571 | S | 9/2004 | Kay | |
| 6,820,519 | B2 | 11/2004 | Lefebvre | |
| D504,288 | S | 4/2005 | Kushner | |
| D511,950 | S | 11/2005 | Lee | |
| 7,216,432 | B2 | 5/2007 | Poteet | |
| D576,003 | S | 9/2008 | Patrizio et al. | |
| D599,635 | S | 9/2009 | Hasegawa | |
| 8,726,764 | B2 | 5/2014 | Burato | |
| D727,703 | S | 4/2015 | Lee | |
| 2002/0157188 | A1 | 10/2002 | Sannajust | |
| 2003/0140733 | A1 | 7/2003 | Miguel | |
| 2011/0138540 | A1 | 7/2011 | Kinskey et al. | |
| 2011/0185859 | A1 | 8/2011 | Brucart-Puig | |
| 2012/0222280 | A1 | 9/2012 | Bernede | |

FOREIGN PATENT DOCUMENTS

| | | |
|---|---|---|
| EP | 1350756 B1 | 5/2006 |
| EP | 2457868 A1 | 5/2012 |

OTHER PUBLICATIONS

Knife Merchant, Messermeister Waiters Bow Corkscrew w/Multi-Wood Handle, 1 page, Internet website: https://www.knifemerchant.com/product.asp?productID=4443, copy retrieved on Jul. 27, 2016.
Santa Fe Stoneworks, The Lodge, 4 pages, Internet website: https://lodgegoods.com/collections/santa-fe-stoneworks?page=2, copy retrieved on Jul. 27, 2016.
Forge De Laguiole, Waiter Style Corkscrews—Stamina Wood Collection, 2 pages, Internet website: https://www.forge-de-laguiole-usa.com/products/waiter-style-corkscrews-stamina-wood-collection, copy retrieved Jul. 27, 2016.

* cited by examiner 10
340
330
40
100
210
50

340
330
40
10
280
50
290
260
250
210
240
180

WINE KEY

CROSS-REFERENCE TO RELATED APPLICATIONS

The present application claims priority to U.S. Provisional Patent Application Ser. No. 62/440,007, filed Dec. 29, 2016, also entitled "Wine Key," the entire contents of which are incorporated herein by reference.

TECHNICAL FIELD

The subject matter of the present disclosure relates, generally, to multi-purpose tools for use in opening sealed beverage bottles. More particularly, the subject matter of the present disclosure relates to that type of multi-purpose tool commonly known as a "wine key."

BACKGROUND

A lever-type corkscrew device—often called a wine key, wine opener, waiter's corkscrew, waiter's friend, sommelier corkscrew, wine corkscrew, cork puller, or corkscrew—is ever-present in both restaurant and home settings, and is a preferred tool for removing a cork stopper from a bottle of wine. Such lever-type corkscrew devices are well-known and oft-used to open corked wine bottles, in part because they require little effort to remove a cork from a bottle, and, in part because they are often compact enough to be easily carried, handled, and manipulated.

Lever-type corkscrews typically comprise a flat handle that is reminiscent of a pocket knife handle, a helical auger that is configured to screw into a cork, an extraction lever that rests on the rim of the wine bottle neck, and a pivot mechanism configured to allow the handle to be lifted for leverage in extracting the cork from the bottle. Some such corkscrews further comprise a bottle opener for a crown cork-type metallic bottle cap, as well as a knife-like blade for cutting and removing the foil seal that is typically found on wine bottles.

Corkscrews are often considered a collectible, due to the decorative aspects of the handle. As well, there are a variety of corkscrew designs that may offer advantage or interest, one over another. It is not uncommon that a user, restaurant, or household will have many corkscrews on-hand, given the typical, significant degree of use of such a device, and given that they are often small enough to be lost, misplaced, stolen, in-use, or being carried by a co-worker or family member.

Notwithstanding, it has been recognized that there are no known kits available for Do-It-Yourself woodworkers to customize their own wine key, allowing them to turn the handle on a lathe and, subsequently, to assemble the component pieces into a finished, customized wine key product.

As well, it has been recognized that improvements may be had over some of the typical functions and overall feel of a lever-type corkscrew.

Accordingly, it is to the disclosure of such wine key devices, as well as corresponding considerations and methods for part selection, manufacture, assembly, use, storage, and transport, that the following is directed.

SUMMARY

The subject matter of the present disclosure relates, in various embodiments, to wine keys meeting the above-described deficiencies noted in prior art devices, while providing certain improvements and resulting benefits to a user thereof.

In some embodiments, a wine key according to the present disclosure comprises a head assembly and a handle assembly. The head assembly may comprise a unique configuration suited for affixing and using a twin neckstand assembly, a foil cutter disk, a spring, and a helical extractor. The twin neckstand assembly may comprise fulcrum notches for providing leverage against a bottle rim to enhance the effectiveness of extracting a cork stopper from the bottle. As well, the twin neckstand assembly may comprise cap reliefs and cap hooks for providing leverage against a bottle cap edge, so as to enhance the effectiveness of its removal.

The handle assembly may comprise a multi-part structure, comprising a handle, an offset tube, a central rod, and an end cap. In some embodiments, and uniquely to known wine key products, the handle may be provided in cylindrical-shaped form that can be turned on a lathe by a Do-It-Yourself woodworker.

In some embodiments, a contoured shape of a second end of the head assembly matches a contoured shape of the affixed handle, so that the interfacing joint is substantially continuous and uniform thereacross for the comfort of the user and for the overall aesthetics of the wine key.

For non-limiting example, and according to some embodiments, the disclosed wine key may be used for purposes of opening a beverage bottle having a stopper, such as a cork, opening a bottle having a pry-off closure, such as a crown cork-type metallic bottle cap, and cutting a seal around a neck of a beverage bottle, such as a foil seal. The overall contoured shape and construction of some such wine key embodiments provide a compact and streamlined form factor, wherein the neckstand fulcrum arms may lie flush with the body of the wine key, so that the wine key conveniently and comfortably may be carried in a pocket, pouch, purse, or the like.

A wine key according to the present disclosure may find particular application, enjoyment, and use within the customizable Do-It-Yourself woodworkers market. Further, a wine key according to the present disclosure would be suitable for personal use or restaurant use. As well, a wine key according to the present disclosure would be an interesting and well-appreciated gift for a wine loving recipient.

Accordingly, one non-limiting objective for a wine key according to the present disclosure is to provide a customizable Do-It-Yourself wine key having each of the typical features and tools for removing the foil seal and cork from a wine bottle, and/or a crown cork-type metallic bottle cap from a bottle that is so-configured.

Another non-limiting objective for a wine key according to the present disclosure is to provide a wine key in kit form, wherein a cylindrical-shaped handle can be turned on a lathe by a Do-It-Yourself woodworker.

Yet another non-limiting objective for a wine key according to the present disclosure is to provide a wine key that is economical in construction, durable, and efficient to use.

These, and other, features, advantages, and benefits shown by the various embodiments of a wine key of the present disclosure, and related processes for creating them, as set forth within the present disclosure, will become more apparent to those of ordinary skill in the art after review of the following Detailed Description of Illustrative Embodiments and Claims in light of the accompanying drawing Figures.

BRIEF DESCRIPTION OF THE DRAWINGS

Accordingly, the within disclosure will be best understood through consideration of, and with reference to, the following drawing Figures, viewed in conjunction with the Detailed Description of Illustrative Embodiments referring thereto, in which like reference numbers throughout the various Figures designate like structure, and in which.

Figures 1, 2:
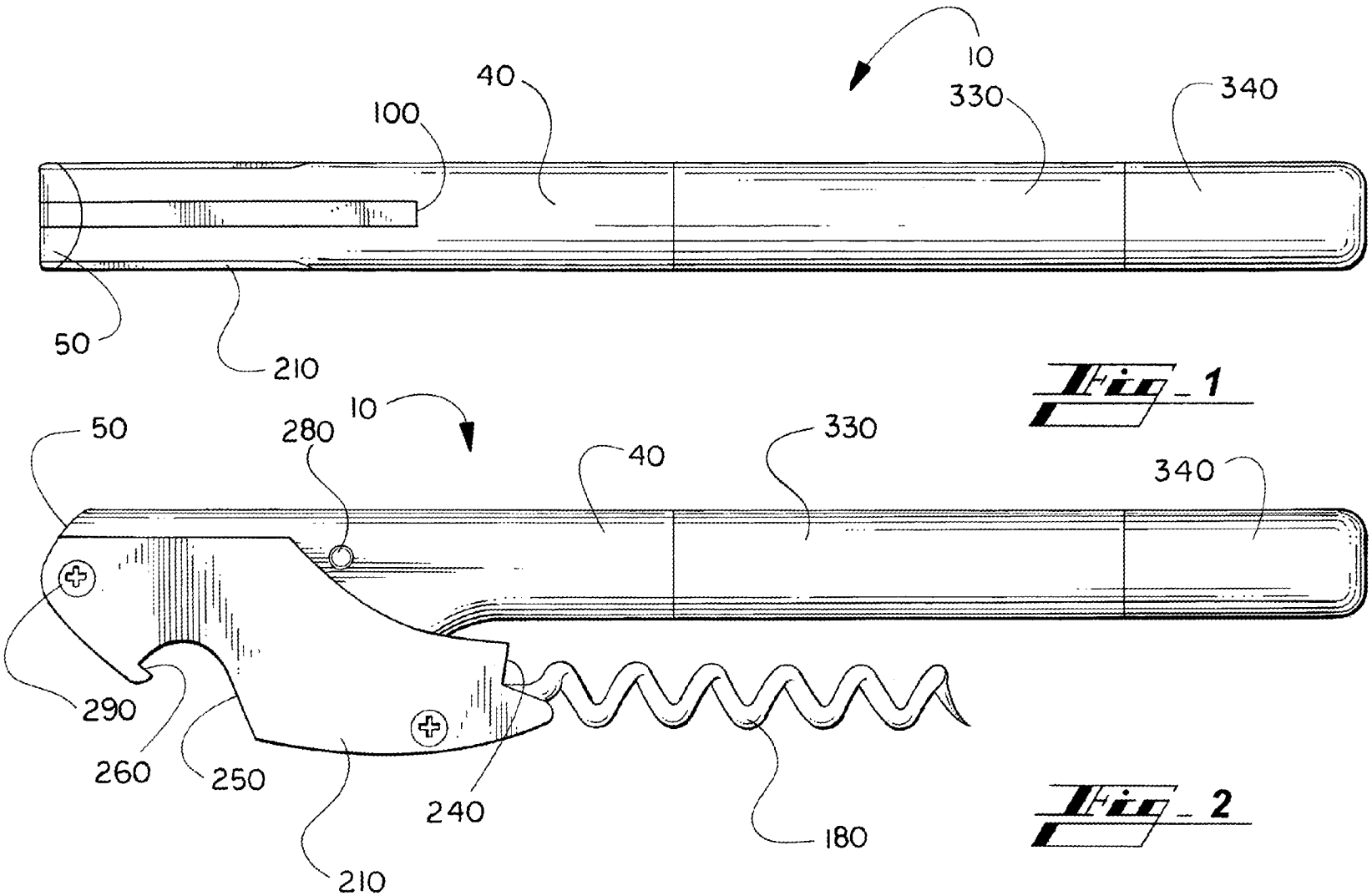
FIG. 1 depicts a rear plan view of a wine key, in accordance with the subject matter of the present disclosure.
FIG. 2 depicts a first side plan view of the wine key of FIG. 1, in accordance with the subject matter of the present disclosure.
Figure 3:
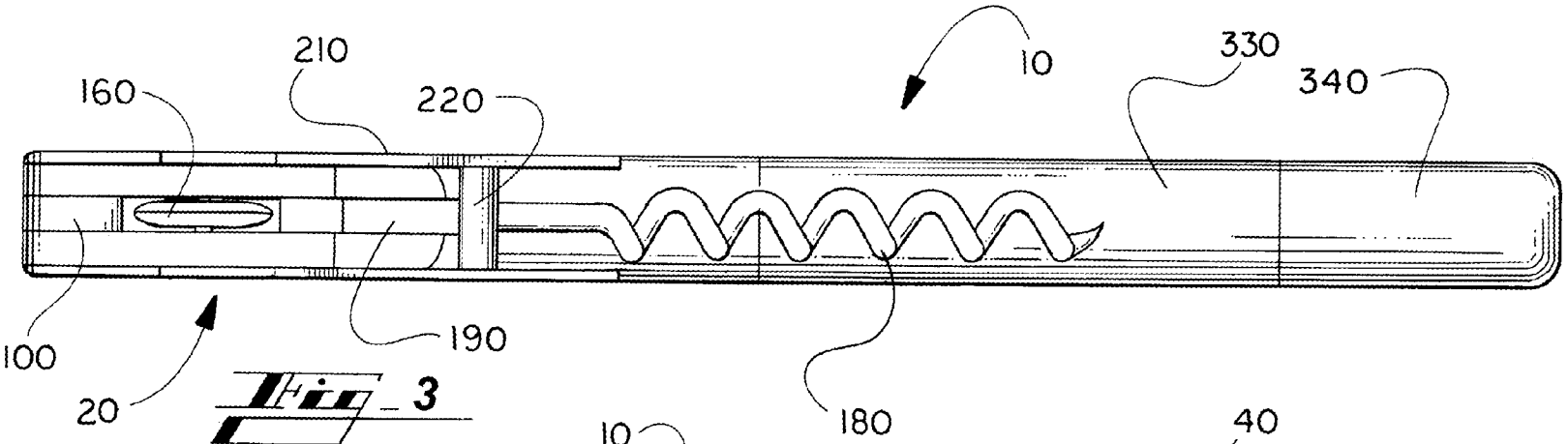
FIG. 3 depicts a front plan view of the wine key of FIG. 1, in accordance with the subject matter of the present disclosure.
Figure 4:
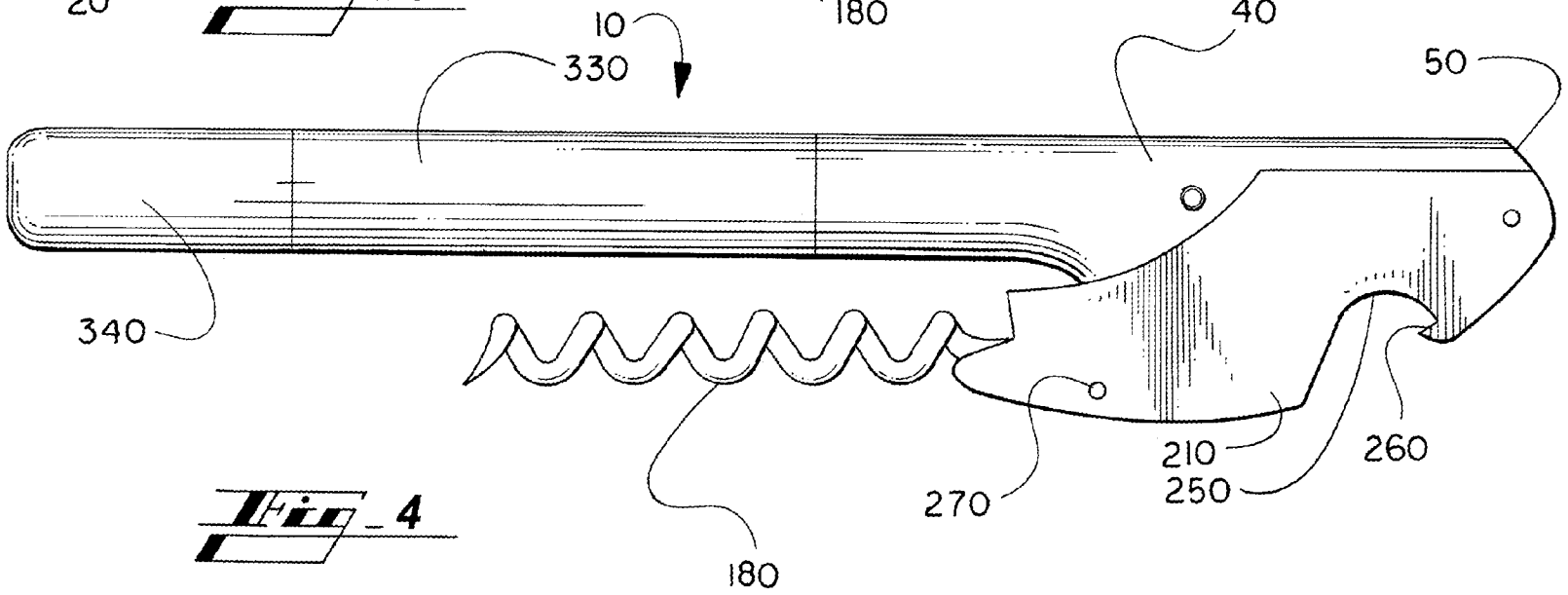
FIG. 4 depicts a second side plan view of the wine key of FIG. 1, in accordance with the subject matter of the present disclosure.
Figure 6:
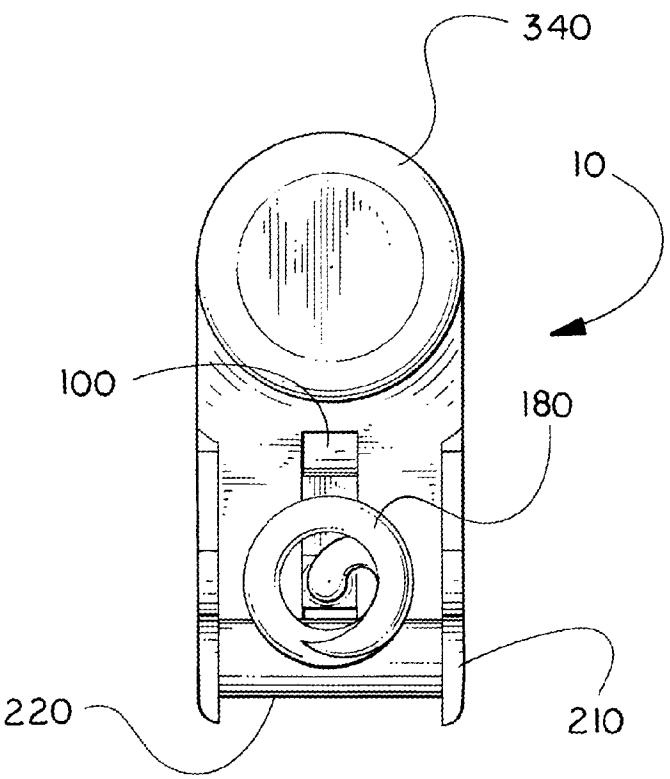
FIG. 6 depicts a bottom end elevation view of the wine key of FIG. 1, in accordance with the subject matter of the present disclosure.
Figure 5:
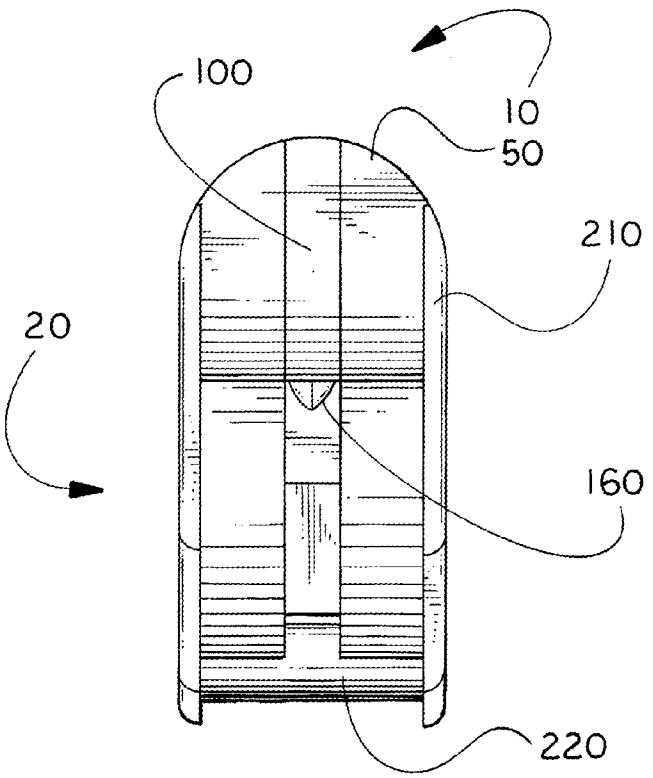
FIG. 5 depicts a top end elevation view of the wine key of FIG. 1, in accordance with the subject matter of the present disclosure.

It is to be noted that the drawing Figures presented are intended solely for the purpose of illustration and that they are, therefore, neither desired nor intended to limit the invention to any or all of the exact details of construction shown, except insofar as they may be deemed essential to the claimed invention.

DETAILED DESCRIPTION OF ILLUSTRATIVE EMBODIMENTS

In describing the several embodiments illustrated in the Figures, specific terminology is employed for the sake of clarity. The invention, however, is not intended to be limited to the specific terminology so selected, and it is to be understood that each specific element includes all technical equivalents that operate in a similar manner to accomplish a similar purpose. Additionally, in the Figures, like reference numerals and like description shall be used to designate corresponding elements, parts, and functionality throughout the several Figures.

Turning now to drawing FIGS. 1-9, generally, there is shown an illustrative embodiment of wine key 10. Wine key 10 comprises head assembly 20 and handle assembly 30.

Head assembly 20 comprises head 40. Perhaps best seen with reference to FIGS. 8 and 9, head 40 comprises contoured first end 50 and contoured second end 60. Contoured first end 50 comprises slot 70, which will be described in greater detail hereinbelow. Contoured first end 50 also comprises flats 80, which abut shoulders 90. It will be appreciated that head 40 may be formed from any material appropriate to the purposes set forth herein; however, in some embodiments, the material preferably is a metal, such as stainless steel, aluminum, or the like. In other embodiments, head 40 may be formed from high density plastics, thermoplastics, acrylics, composites, wood, or the like. Head 40 may be formed, as appropriate, by casting, molding, stamping, pressing, machining, or the like, and combinations thereof.

Head assembly 20 further comprises contoured spring 100. Contoured spring 100 is configured so as to fit within slot 70; and, thereby, to conform to the contours of, and to cooperate with the functions served by, head 40. Accordingly, contoured spring 100 further comprises cutter disk relief 110, spring arm 120, spring arm relief 130, first end mounting portion 140, and second end mounting portion 150. Contoured spring 100 may be formed from any material appropriate to the purposes set forth herein; however, in some embodiments, the material preferably is a metal. In other embodiments, contoured spring 100 may be formed from plastic, thermoplastic, composites, and the like, and combinations thereof. In some embodiments, contoured spring 100, or an appropriate portion thereof, may be thermally treated so as to enhance the spring-like characteristics of spring arm 120. Contoured spring 100

Head assembly 20 is configured to carry and provide for convenient rotational operation of foil cutter disk 160. Foil cutter disk 160 preferably is round and relatively thin, and is configured to fit and operate within slot 70 and cutter disk relief 110 of contoured spring 100. In some embodiments, foil cutter disk 160 may be shaped so that the outside edge tapers into a relatively sharp, circular blade. In some embodiments, foil cutter disk 160 is formed of a carbon composite material; whereas, in other embodiments, it may be formed of any conventional metal appropriate to the use and purposes set forth herein. As will be described in greater detail hereinbelow, foil cutter disk 160 is provided to score and cut a seal from around a neck of a beverage bottle, such as a foil seal.

It can be seen that the contoured shapes provided by head 40 and by cutter disk relief 110 of contoured spring 100 are shaped so as to accommodate the body of foil cutter disk 160, while allowing the outermost portion of the circular cutting blade to protrude slightly from slot 70. In considering use of wine key 10, and with particular reference to FIG. 8, it can be seen that the cooperatively contoured portions of head 40 and contoured spring 100 provide a curvilinear surface within which to comfortably rest a foil or otherwise sealed neck of a bottle, such as a wine bottle. In such position and configuration, the slightly protruding portion of foil cutter disk 160 can bear against the bottle neck, cutting through the foil seal either as wine key 10 is rotated about the bottle or as the bottle is rotated within wine key 10.

Accordingly, foil cutter disk 160 is believed to be safer than a conventional, knife-type cutter, because it does not employ a blade that extends from the main body of the wine key. As well, it is simpler to use due to the above-described ergonomic design and it is more efficient because it involves fewer steps for the user. As well, this type of foil cutter is safer for air travel and general transport.

Head assembly 20 is also configured to carry and provide for convenient operation of helical extractor 170. Helical extractor 170 comprises helical or spiral auger-shaped portion 180, often called a corkscrew, and mounting end 190. Helical extractor 170 is pivotally affixed within slot 70 to a mounting protrusion formed approximately at the the center of head 40. In a first, closed configuration, helical extractor 170 is stowed parallel to handle assembly 30. In a second, open configuration, helical extractor 170 may be rotated outwardly, so that it is approximately perpendicular to handle assembly 30. As will be described in greater detail hereinbelow, helical extractor 170 may be used for purposes of opening a beverage bottle having a stopper, such as a natural or artificial cork.

It will be appreciated that, when assembled, spring arm 120 of contoured spring 100 is configured so as to bear against a side of mounting end 190 of helical extractor 170; and, thereby, to offer resistance to rotation of helical extractor 170 out of a closed configuration, and to guard against damage to handle assembly 30. As helical extractor 170 is rotated from its closed configuration, perhaps best seen with reference to FIG. 7, and into its open configuration, perhaps best seen with reference to FIG. 8, spring arm 120 will flex and bend toward spring arm relief 130. So loaded, spring arm 170 offers resistance to the distal end portion of mounting end 190; thereby, guarding against inadvertent closure of helical extractor 170.

Twin neckstand assembly 200 is carried by, and is pivotally attached to, head 40, adjacent contoured first end 50. Twin neckstand assembly 200 comprises first and second neckstand fulcrum arms 210. As with the other components described hereinabove, first and second neckstand fulcrum arms 210 may be formed from any material appropriate to the intended use. In some embodiments, the material preferably is a metal, such as stainless steel, aluminum, or the like. In other embodiments, first and second neckstand fulcrum arms 210 may be formed from high density plastics, thermoplastics, composites, or the like. First and second neckstand fulcrum arms 210 may be formed, as appropriate, by casting, molding, stamping, pressing, machining, or the like, and combinations thereof.

First and second neckstand fulcrum arms 210 are maintained in spaced-apart alignment by virtue of being mounted to head 40 adjacent contoured first end 50, and by virtue of spacer 220 located at a distal position along first and second neckstand fulcrum arms 210. In association with appropriate fastener elements, described hereinbelow, spacer 220 further acts to provide structural integrity to twin neckstand assembly 200. It will be appreciated that, in some embodiments, twin neckstand assembly may be cast, stamped, machined, or otherwise formed from a single piece of material, and then folded, pressed, or otherwise mechanically manipulated into a form equivalent in shape and form to twin neckstand assembly 200 shown in the several drawing Figures. In such embodiments, it will be appreciated that spacer 220 may be omitted in favor of an integral bridging element (not shown) located approximately at the same position as spacer 220 and providing similar structural rigidity and function.

First and second neckstand fulcrum arms 210 are contoured so as to provide particular favorable attributes and benefits to the use, operation, carrying, and storage of wine key 10. More particularly, when twin neckstand assembly 200 is folded or pivoted over flats 80 and into a stowed or storage configuration, concave surfaces 230 of contoured neckstand fulcrum arms 210 abut shoulders 90 of head 40. Accordingly, shoulders 90 of head 40, in cooperation with concave surfaces 230 of neckstand fulcrum arms 210, provide bilateral stops against which twin neckstand assembly 200 rests and against which it is constrained from further rotation. Further advantageously, neckstand fulcrum arms 210 lie flush with the body of wine key 10, by virtue of flats 80 and shoulders 90 providing full dimensional accommodation of the thickness of each neckstand fulcrum arm 210. It should be noted that, in this stowed or storage configuration, twin neckstand assembly 200 also serves to protect foil cutter disk 160 from damage.

First and second neckstand fulcrum arms 210 further provide fulcrum notches 240, the purpose and use of which will be described in greater detail hereinbelow. Convex surfaces 245 provide safe and comfortable curvature when wine key 10 is grasped within the user's hand. As well, convex surfaces 245 provide, in part, a compact and streamlined form factor, so that wine key 10 conveniently and comfortably may be carried in a pocket, pouch, purse, or the like.

First and second neckstand fulcrum arms 210 further provide cap reliefs 250, which, in association with cap hooks 260, provide for convenient insertion and removal of a pry-off bottle closure, such as a crown cork-type metallic bottle cap, of the type affixed to and held by the rim of a beverage bottle. As was described above with regard to use and operation of foil cutter disk 160, and with particular reference to FIG. 7, it again should be noted that the cooperatively contoured portions of head 40 and contoured spring 100 provide a curvilinear surface having similar contour to cap reliefs 250, so that appropriate clearance is provided for insertion and removal of a pry-off bottle closure.

Returning to head assembly 20, as a whole, and, thereby, to each above-described element carried by head assembly 20, a plurality of respectively aligned holes 270 are provided. Holes 270 serve to locate and align, respectively, each major element and/or subassembly carried by head 40, such as, but not limited to, head 40, contoured spring 100, foil cutter disk 160, helical extractor 170, and twin neck assembly 200. Holes 270 may be configured in some embodiments to accommodate pins 280, seen for example in FIG. 2, in which case they may be dimensioned so as to provide an interference (tight) fit with a respective pin 280. Holes 270 may be configured in some embodiments to accommodate screw fasteners 290, also seen for example in FIG. 2, in which case a first hole 270 may be straight bored to accommodate the shoulder of a corresponding screw fastener 290, and a corresponding second hole 270 may be threaded to accommodate the screw threads of corresponding screw fastener 290. As well, in some embodiments, holes 270 may be provided with countersunk portion 300, so that a head of corresponding screw fastener 290 will lie flush with (in the plane of) the surface carrying corresponding hole 270. In some embodiments, an appropriate mixture or combination of pins 280 and screw fasteners 290 may be used, in association with or in lieu of use of other fastening means known in the art, and respective holes 270 may be provided in such configuration so as to insure cooperation therewith.

Figure 9:
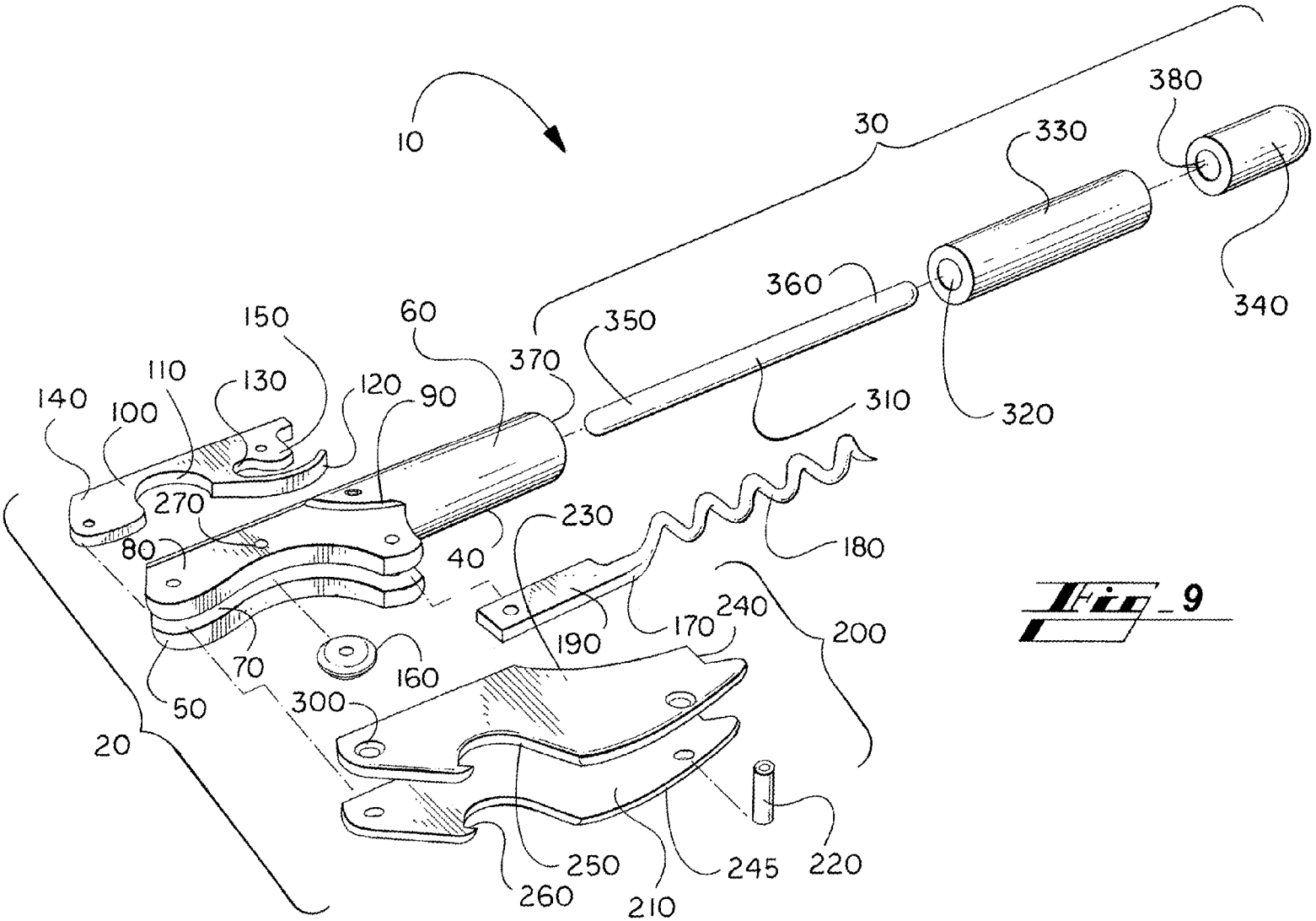
FIG. 9 depicts a first side exploded perspective view of the wine key of FIG. 1, in accordance with the subject matter of the present disclosure.

With continued reference to FIG. 9, we now return to handle assembly 30. In some embodiments, handle assembly 30 comprises central rod 310, offset tube 320, handle 330, and end cap 340. Preferably, the external contour of handle 330 closely matches the external contour of contoured second end 60 of head 40 and end cap 340, at least with regard to shape and size. Accordingly, for illustrative purposes in the depicted embodiment, these respective contours are of round shape and are of substantially the same outside diameter, so that the interfacing joint is substantially continuous and uniform thereacross for the comfort of the user and for the overall aesthetics of wine key 10. In other embodiments, however, these respective contours may be of other cross-sectional shapes, such as, by way of non-limiting example, hexagonal or other multi-faceted shape.

As with the other components described hereinabove, handle 330 and end cap 340 may be formed from any material appropriate to the intended use. In some embodiments, the material preferably is wood, acrylic, bone, and/or stone. In other embodiments, handle 330 and/or end cap 340 may be formed from metals, high density plastics, thermoplastics, composites, or the like. Handle 330 and end cap 340 may be formed, as appropriate, by machining, casting, molding, or the like, and combinations thereof. For reasons that will be described in greater detail hereinbelow, in a preferred embodiment, handle 330 is wood, acrylic, bone, and/or stone, beginning in the form of an offset blank, that is subsequently turned by a user, for example, on a lathe; and end cap 340 preferably is of the same material as head 40, such as stainless steel.

Central rod 310 comprises first rod end 350 and second rod end 360. In some embodiments, central rod 310 may comprise a threaded rod; that is, a rod that is threaded over substantially the entirety of the exterior of central rod 310 from first rod end 350 to second rod end 360. In other embodiments, central rod 310 may be threaded over only a portion of first rod end 350 and second rod end 360. In yet other embodiments, central rod 310 may not be threaded at all.

Offset tube 320 may be inserted within a central bore formed in handle 330. Conventionally, offset tube 320 is formed of brass; however, in alternative embodiments, other appropriate materials may be utilized. Central rod 310 may be inserted into and through offset tube 320 and handle 330. Advantageously, central rod 310, being longer than offset tube 320 and handle 330, may serve to join head 40 to handle 330, and handle 330 to end cap 340. For this purpose, head 40 may comprise a limited-depth hole 370 formed within contoured second end 60. In some embodiments, hole 370 may be threaded so as to cooperatively engage threaded first rod end 350. Similarly, end cap 340 may comprise a limited-depth hole 380 formed therewithin. In some embodiments, hole 380 may be threaded so as to cooperatively engage threaded second rod end 360.

Accordingly, in such embodiments as may be provided with threaded central rod 310, head assembly 20 is assembled to handle assembly 30 by rotational, cooperative tightening of screw-together handle assembly 30 against head assembly 20. In other embodiments, head assembly 20 may be affixed to handle assembly 30 by other means of mechanical and/or chemical joinder. For example, head assembly 20 may be joined to handle assembly 30 via adhesive, pins, alternatively configured threaded components, alternatively configured tensioning means, such as flange and cap means, or otherwise, without limitation.

We now turn to aspects of the present disclosure that are relevant to manufacture, assembly, storage, and use of wine key 10.

In accordance with the subject matter disclosure hereof, wine key 10 is intended to be used for purposes of opening a beverage bottle having a stopper, such as a cork, opening a bottle having a pry-off closure, such as a crown cork-type metallic bottle cap, and cutting a seal around a neck of a beverage bottle, such as a foil seal. Notwithstanding, the overall contoured shape and construction of wine key 10 provides a compact and streamlined form factor, featuring neckstand fulcrum arms 210 that lie flush with the body of wine key 10, so that wine key 10 conveniently and comfortably may be carried in a pocket, pouch, purse, or the like.

Figure 8:
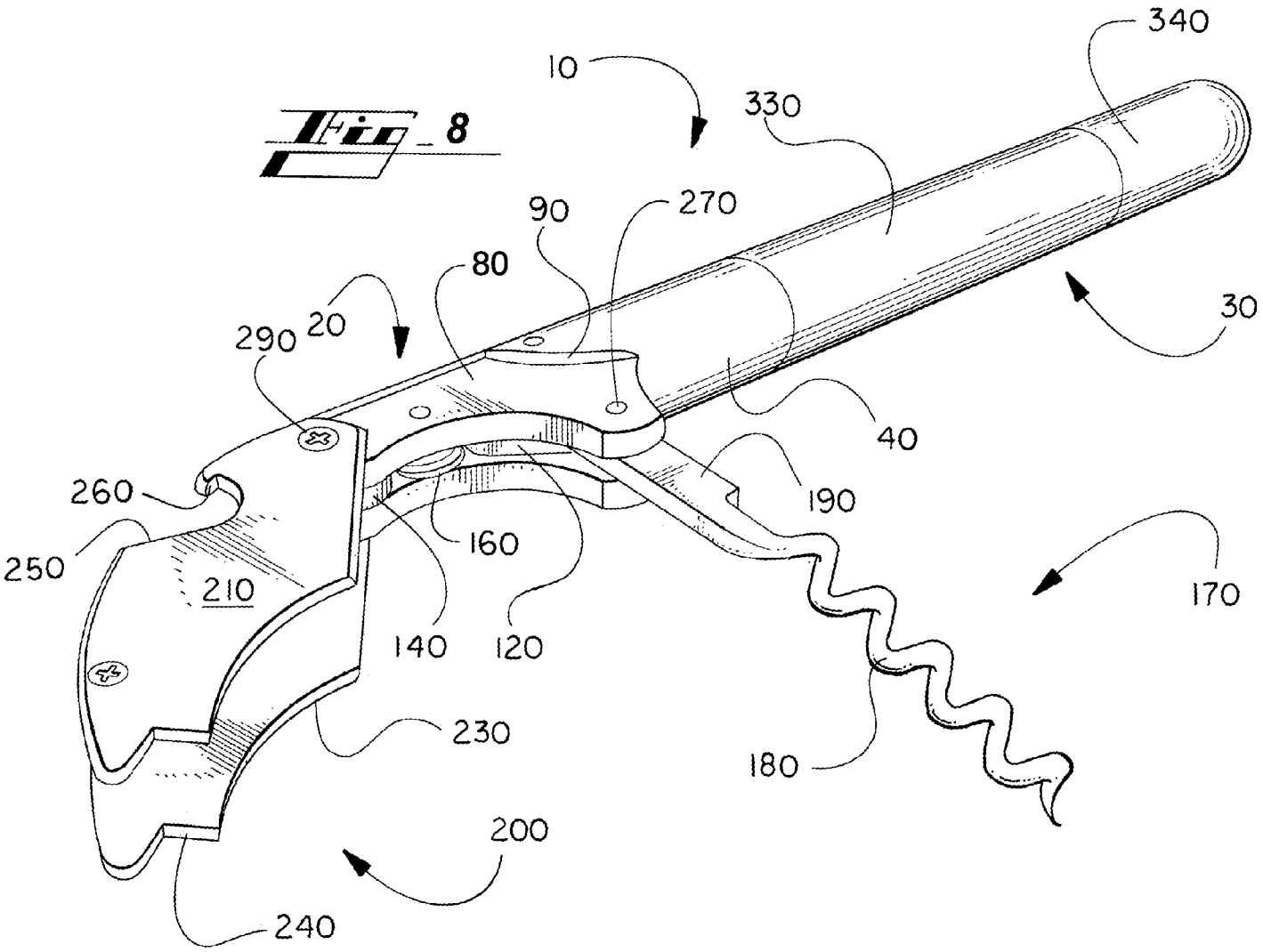
FIG. 8 depicts a first side perspective view of the wine key of FIG. 1, in an open configuration, in accordance with the subject matter of the present disclosure.

In using wine key 10 for purposes of opening a conventional wine bottle having a foil seal and cork, twin neckstand assembly 200 is rotated outwardly, as depicted in the configuration of FIG. 8. Foil disk cutter 160 is used in the manner described above to score and cut the foil seal away from the bottle neck and top. Auger-shaped portion 180 of helical extractor 170 is rotated into an open position, also as shown in the configuration of FIG. 8, and is inserted into the bottle's cork. Wine key 10 is rotated in conventional manner so that auger-shaped portion 180 of helical extractor 170 is deeply engaged within the cork. Fulcrum notches 240 adjacent the ends of twin neckstand assembly 200 are engaged between the cork and the rim of the bottle; whereafter, handle assembly 30 may be lifted to act as a lever operating in association with a fulcrum, so as to facilitate removal of the cork from the bottle with minimal effort.

Figure 7:
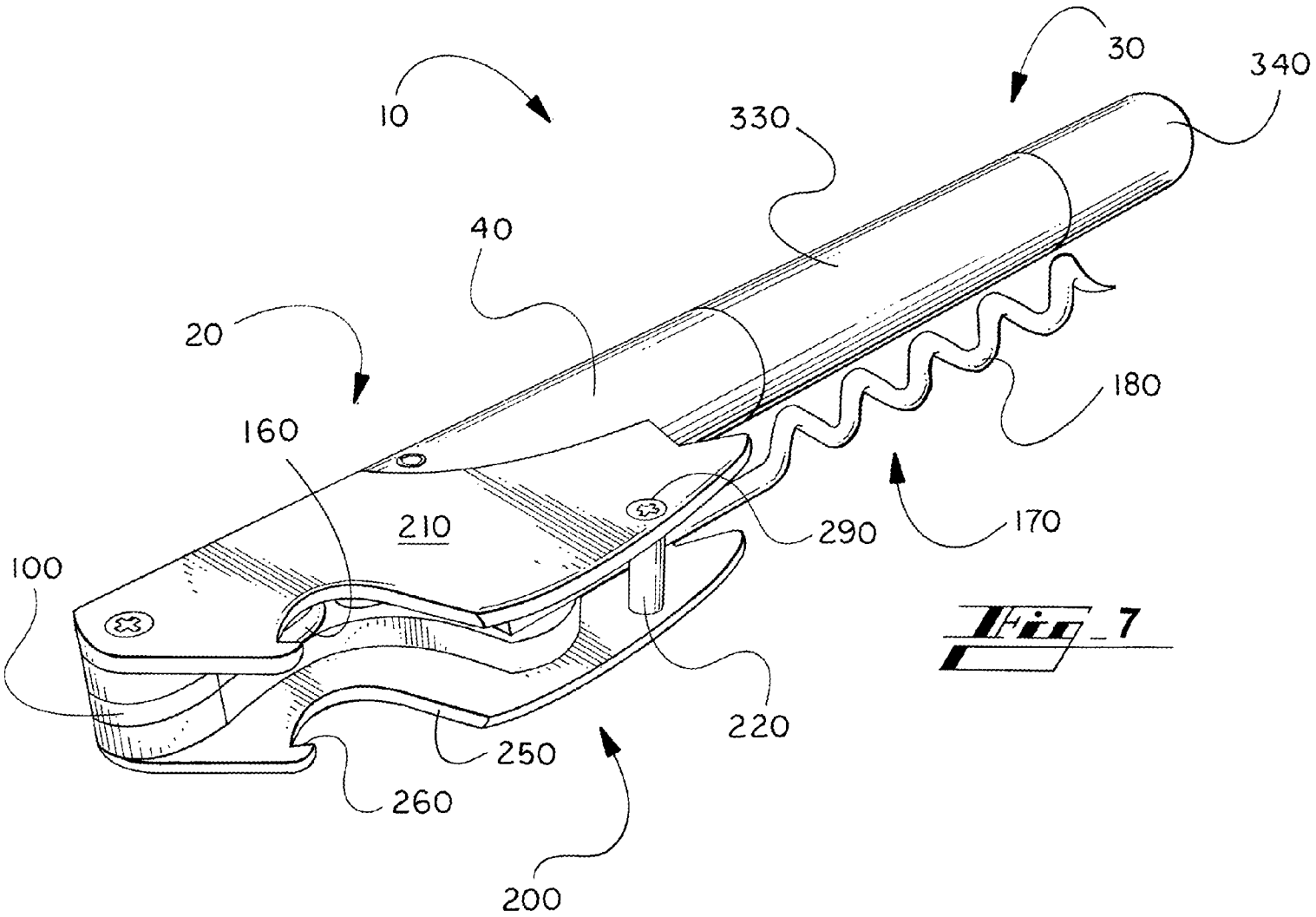
FIG. 7 depicts a first side perspective view of the wine key of FIG. 1 in a closed configuration, in accordance with the subject matter of the present disclosure.

On the other hand, should one wish to use wine key 10 to open a beverage bottle, such as a beer bottle or other beverage bottle having a conventional bottle cap, both helical extractor 170 and twin neckstand assembly 200 are rotated into closed or stowed configuration, such as that depicted within FIG. 7. The bottle rim bearing the bottle cap is then inserted into cap reliefs 250 and against cap hooks 260, in conventional position wherein cap hooks 260 are disposed to grasp the bottle cap along its descending edge. Handle assembly 30 then may be rotated to pry the bottle cap from the bottle's rim.

In considering the attributes, unique construction, and form factor of wine key 10, one of ordinary skill in the art might recognize that wine key 10 was designed to be easily handcrafted, customized, personalized, and assembled. In some embodiments, for example, the outer portion of handle 330 may be turned and customized on a lathe prior to assembly.

Accordingly, wine key 10 may be provided in convenient kit form, perhaps serving the Do-It-Yourself ("DIY") market. Alternatively, any of the component parts of wine key 10, or selected ones thereof, may be provided in separate form or packaging, enabling the DIY craftsperson to select from amongst various options, such as, but not limited to: choices of custom lengths, diameters, and/or configurations for handle assembly 30; particular material choices that may be aesthetically pleasing to the craftsperson, such as selections of wood, acrylic, bone, and/or stone for handle 330, choices of materials, styles, and designs for head assembly 20 and/or end cap 340, and the like; choices of types and colors of finishes; choices of shapes and sizes for contoured second end 60 of head 40 and handle 330; and choices of preferred forms and/or methods for joinder of the parts comprising wine key 10. Wine key 10 further may be personalized by engraving, stamping, inlay, or other artistic application of initials, names, and/or designs. With such flexibility and choice, the craftsperson may construct, customize, and personalize wine key 10 into whatever form may suit her.

This ability of wine key 10 to be customized, to have parts interchanged and/or replaced, and/or to be otherwise modified is believed to be a unique attribute amongst known wine key products. By comparison, traditional wine keys are most often provided in a pocket knife-like configuration, which, disadvantageously, cannot be custom-configured.

Of course, wine key 10 is designed to last a lifetime. It is portable and can easily be carried in a pocket or purse.

Having thus described exemplary embodiments of the subject matter of the present disclosure, it is noted that the within disclosures are illustrative only and that various other alternatives, adaptations, and modifications may be made within the scope and spirit of the present invention. Accordingly, the present subject matter is not limited to the specific embodiments as illustrated herein, but is limited only by the claims set forth hereinbelow.

PARTS/FEATURES LIST

Part Number Part Name
10 wine key
20 head assembly
30 handle assembly
40 head
50 contoured first end
60 contoured second end
70 slot
80 flats
90 shoulders
100 contoured spring
110 cutter disk relief
120 spring arm
130 spring arm relief
140 first end mounting portion
150 second end mounting portion
160 foil cutter disk
170 helical extractor
180 auger-shaped portion
190 mounting end
200 twin neckstand assembly
210 neckstand fulcrum arms
220 spacer
230 concave surfaces
240 fulcrum notches
245 convex surfaces
250 cap reliefs
260 cap hooks
270 holes
280 pins
290 screw fasteners
300 countersunk portion
310 central rod
320 offset tube
330 handle
340 end cap
350 first rod end
360 second rod end
370 hole
380 hole

What is claimed is:

1. A wine key comprising:

a head assembly and a handle assembly;

said head assembly comprising a contoured head, said contoured head comprising a contoured slot;

a contoured spring disposed within said slot, said contoured spring comprising a spring arm;

a helical extractor comprising a mounting end disposed within said contoured slot, said mounting end bearing against said spring arm;

a foil-cutter disk disposed within said contoured slot and within a cutter disk relief formed within said contoured spring; and a twin neckstand carried by a contoured first end of said contoured head;

said contoured head comprising a contoured second end, said contoured second end matching a contour of said handle assembly at the junction thereof.

2. The wine key of claim 1, wherein said twin neckstand comprises fulcrum arms in spaced-apart relationship.

3. The wine key of claim 1, wherein said twin neckstand is configured to pivot about its attachment point upon said contoured head.

4. The wine key of claim 1, wherein said twin neckstand comprises fulcrum arms, said fulcrum arms further comprising fulcrum notches configured to provide leverage against a bottle rim to enhance the effectiveness of extracting a cork stopper from a bottle.

5. The wine key of claim 1, wherein said twin neckstand comprises fulcrum arms, said fulcrum arms further comprising cap reliefs and cap hooks configured to provide leverage against a pry-off-type bottle cap edge, so as to enhance the effectiveness of removal of the bottle cap.

6. The wine key of claim 1, wherein said twin neckstand comprises fulcrum arms, and wherein said head assembly comprises flats and corresponding shoulders formed within sides of said head assembly, each of said fulcrum arms configured to lie in a flush configuration against a corresponding flat and abutting a corresponding shoulder when said wine key is in a stowed or storage configuration.

7. The wine key of claim 1, wherein said twin neckstand is configured to protect said foil-cutter disk from damage when said wine key is in a stowed or storage configuration.

8. The wine key of claim 1, wherein said handle assembly comprises a handle, a central rod, and an end cap.

9. The wine key of claim 8, wherein said handle is cylindrical-shaped.

10. The wine key of claim 8, wherein said central rod carries external threads at each end thereof, and wherein said end cap comprises an internally threaded hole therewithin for joinder with said first threaded end of said central rod, and wherein said head comprises an internally threaded hole therewithin for joinder with said second threaded end of said central rod.

11. The wine key of claim 8, further comprising an offset tube.

12. The wine key of claim 1, wherein said junction between said contoured second end of said contoured head and said contour of said handle assembly is substantially continuous and uniform thereacross.

13. A wine key comprising:

a head assembly and a handle assembly;

said head assembly comprising a contoured head, said contoured head comprising a contoured slot;

a contoured spring disposed within said slot, said contoured spring comprising a spring arm;

a helical extractor comprising a mounting end disposed within said contoured slot, a portion of said mounting end bearing against said spring arm;

a foil-cutter disk disposed within said contoured slot and within a cutter disk relief formed within said contoured spring; and a twin neckstand comprising spaced-apart fulcrum arms, said twin neckstand carried by a contoured first end of said contoured head, said twin neckstand configured to pivot about its attachment point upon said contoured head;

said contoured head comprising a contoured second end, said contoured second end matching a contour of said handle assembly at the junction thereof.

14. The wine key of claim 13, wherein said fulcrum arms comprise fulcrum notches, said fulcrum notches configured to provide leverage against a bottle rim to enhance the effectiveness of extracting a cork stopper from a bottle, and wherein said fulcrum arms further comprise cap reliefs and cap hooks, said cap reliefs and cap hooks configured to provide leverage against a pry-off-type bottle cap edge, so as to enhance the effectiveness of removal of the bottle cap.

15. The wine key of claim 13, wherein said head assembly comprises flats and corresponding shoulders formed within sides of said head assembly, each of said fulcrum arms configured to lie in a flush configuration against a corresponding flat and abutting a corresponding shoulder when said wine key is in a stowed or storage configuration.

16. The wine key of claim 13, wherein said twin neckstand is configured to protect said foil-cutter disk from damage when said wine key is in a stowed or storage configuration.

17. The wine key of claim 13, wherein said handle assembly comprises a handle, an offset tube, a central rod, and an end cap.

18. The wine key of claim 13, wherein said junction between said contoured second end of said contoured head and said contour of said handle assembly is substantially continuous and uniform thereacross.

19. A wine key comprising:

a head assembly and a handle assembly, said handle assembly comprising a handle, a central rod, and an end cap;

said head assembly comprising a contoured head, said contoured head comprising a contoured slot;

a contoured spring disposed within said slot, said contoured spring comprising a spring arm;

a helical extractor comprising a mounting end disposed within said contoured slot, a portion of said mounting end bearing against said spring arm;

a foil-cutter disk disposed within said contoured slot and within a cutter disk relief formed within said contoured spring; and a twin neckstand comprising spaced-apart fulcrum arms, said twin neckstand carried by a contoured first end of said contoured head, said twin neckstand configured to pivot about its attachment point upon said contoured head;

said fulcrum arms of said twin neckstand comprising fulcrum notches, said fulcrum notches configured to provide leverage against a bottle rim to enhance the effectiveness of extracting a cork stopper from a bottle, said fulcrum arms further comprising cap reliefs and cap hooks, said cap reliefs and cap hooks configured to provide leverage against a pry-off-type bottle cap edge, so as to enhance the effectiveness of removal of the bottle cap;

said contoured head comprising a contoured second end, said contoured second end matching a contour of said handle assembly at the junction thereof.

20. The wine key of claim 19, wherein said head assembly comprises flats and corresponding shoulders formed within sides of said head assembly, each of said fulcrum arms configured to lie in a flush configuration against a corresponding flat and abutting a corresponding shoulder when said wine key is in a stowed or storage configuration.

* * * * *